United States Patent [19]

Tuzson

[11] 4,152,376

[45] May 1, 1979

[54] CHARGE FORMING APPARATUS WITH VARIABLE AIR-FUEL RATIO CONTROL

[75] Inventor: John J. Tuzson, Evanston, Ill.

[73] Assignee: Borg-Warner Corporation, Chicago, Ill.

[21] Appl. No.: 860,429

[22] Filed: Dec. 14, 1977

[51] Int. Cl.[2] ..... F02M 7/16

[52] U.S. Cl. ..... 261/36 A; 123/119 EC; 137/604; 261/66; 261/DIG. 74

[58] Field of Search ..... 261/36 A, 50 A, 66, 261/DIG. 74; 123/119 EC; 137/604

[56] References Cited

U.S. PATENT DOCUMENTS

| | | | |
|---|---|---|---|
| 1,167,217 | 1/1916 | Reichenbach | 261/50 A |
| 2,940,436 | 6/1960 | De Clair, Jr. et al. | 261/39 D |
| 3,785,627 | 1/1974 | Vaughn et al. | 261/36 A |
| 3,794,302 | 2/1974 | Diener | 261/36 A |
| 3,796,413 | 3/1974 | Woods | 261/36 A |
| 3,977,382 | 8/1976 | Hallberg et al. | 261/36 A |

FOREIGN PATENT DOCUMENTS

| | | | |
|---|---|---|---|
| 917154 | 8/1954 | Fed. Rep. of Germany | 261/50 A |
| 1191177 | 4/1965 | Fed. Rep. of Germany | 261/36 A |
| 2615096 | 10/1976 | Fed. Rep. of Germany | 123/119 EC |
| 2529663 | 1/1977 | Fed. Rep. of Germany | 123/119 EC |

*Primary Examiner*—Tim R. Miles
*Attorney, Agent, or Firm*—Herman E. Smith

[57] ABSTRACT

Charge forming apparatus in which impact of an air stream upon a stream of fuel exposed in a channel displaces fuel into the air stream to form a mixture, wherein the length of the fuel stream exposed to the air stream can be varied for controlling the proportions of fuel and air in the mixture.

3 Claims, 10 Drawing Figures

CHARGE FORMING APPARATUS WITH VARIABLE AIR-FUEL RATIO CONTROL

BACKGROUND OF THE INVENTION

1. Field

The present invention relates to charge forming apparatus of a type in which a stream of air impinges upon a stream of fuel causing a portion of fuel to separate from the fuel stream and mix with the air stream.

2. Prior Art

The prior art includes U.S. Pat. No. 3,785,627 which shows charge forming apparatus in which fuel is dispersed from a fuel channel into an air stream in accordance with changes in the shape of the fuel stream resulting from impingement of the air stream on the fuel stream. The length of a gap in a fuel channel, exposed to the air stream, is manually adjustable to provide a desired air-fuel ratio. Several gapped fuel channels may be employed in a single air stream such that the combined air-fuel ratios of the several fuel channels provide an overall air fuel ratio characteristic for the apparatus. The prior art also includes U.S. Pat. No. 3,977,382 wherein the flow rate of a stream of fuel in a channel is regulated in order to influence the proportion of fuel displaced from a gap in the channel. The flow rate of the fuel stream, and therefore the air-fuel ratio, can be adjusted without disturbing the exposed length of the gap in the fuel channel. Adjustment of the air-fuel ratio can be continuously varied in response to a remotely monitored condition by varying the flow rate of the fuel stream in the fuel channel. The prior art also includes U.S. Pat. No. 2,940,436 which shows a fuel pressure operated injector device having a nozzle assembly extending into an air passage wherein a hollow needle valve is opened by fuel pressure so that a jet of fuel is directed upwardly against a baffle member for dispersion into the air passage.

SUMMARY OF THE INVENTION

The present invention is directed to improvements in charge forming apparatus of a type in which impact of an air stream upon a fuel stream results in displacement of fuel from the fuel stream into the air stream to form an air-fuel mixture. More particularly, the present invention contemplates providing a movable shield covering a portion of the fuel stream for controlling the length of the fuel stream exposed to impact by the air stream. Reciprocation of the shield can be controlled in response to a remotely sensed condition for changing the proportions of air and fuel in the mixture.

DESCRIPTION OF THE PREFERRED EMBODIMENT

Figure 1:
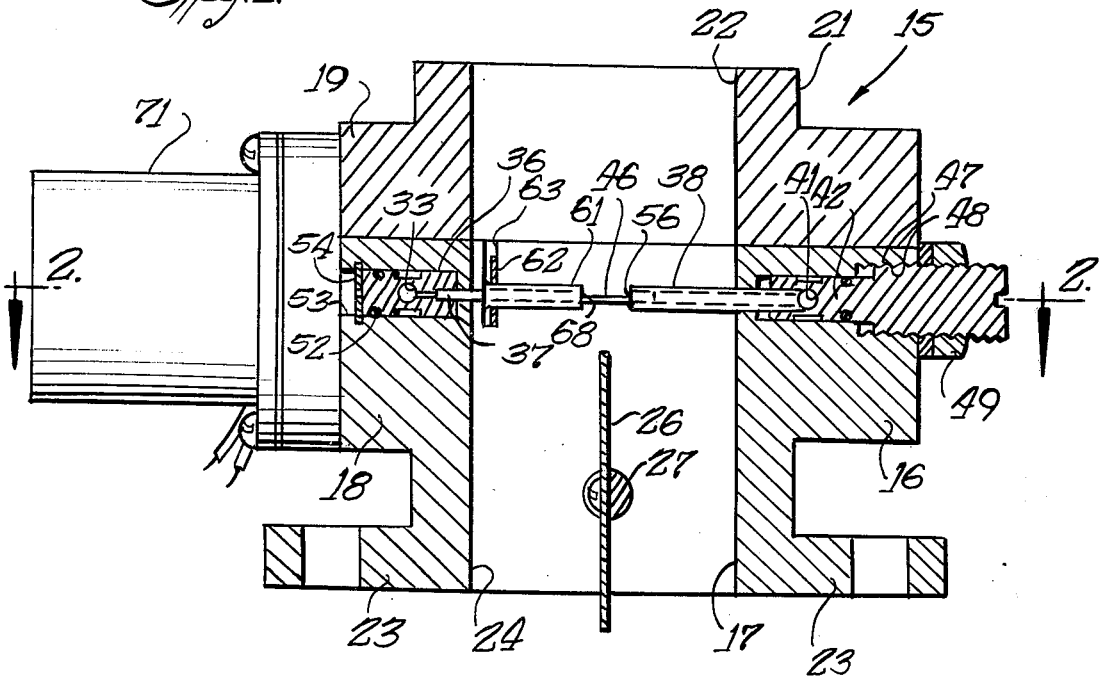
FIG. 1 is a section view in elevation of charge forming apparatus according to the present invention.
Figure 2:
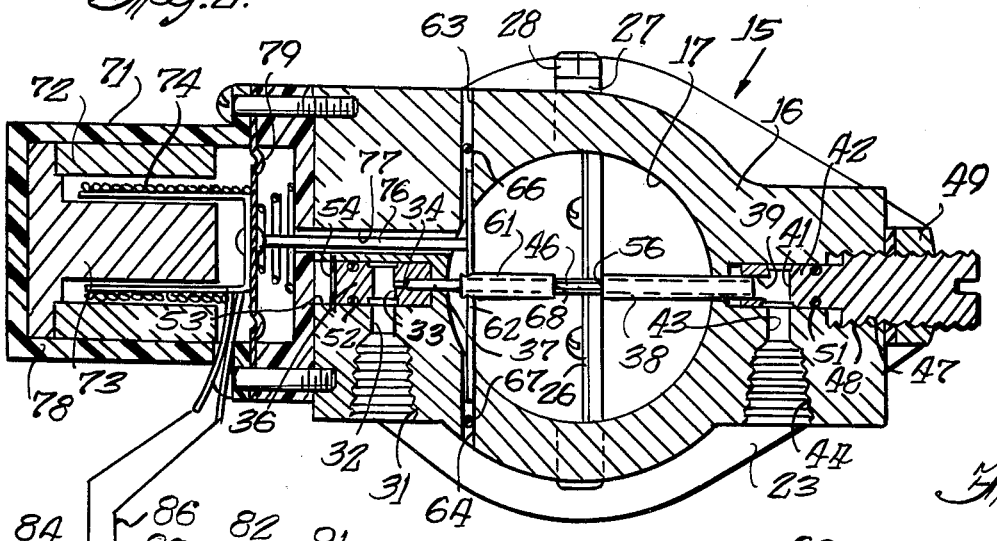
FIG. 2 is a section view of the charge forming apparatus taken along the line 2—2 of FIG. 1.

Referring now in more detail to the drawings, FIGS. 1 and 2 show section views of charge forming apparatus 15 including a body 16 having an air induction passage 17 defined therein. If desired, the body 16 may be formed of two portions 18, 19 stacked one upon the other as shown in FIG. 1. A boss portion 21 is provided on body 16 surrounding the air inlet end 22 of induction passage 17 for mounting an air cleaner. A flange portion 23 is provided on body 16 adjacent the mixture outlet end 24 of induction passage 17 for mounting the charge forming appartus on the inlet manifold of an engine. A throttle plate 26 is mounted in induction passage 17 on a rotatable shaft 27. Connector means 28 is formed on shaft 27 for connection to an external throttle control mechanism by means of which throttle plate 26 can be rotated in passage 17 for restricting air flow therethrough. Fuel passages are provided in body 16 including an inlet port 31, inlet passage 32, openings 33, 34 in inlet fitting 36, jet tube 37 and receiver tube 38 forming a fuel channel extending across passage 17, openings 39, 41 in outlet fitting 42, outlet passage 43 and outlet port 44. The jet tube 37 is formed with a gap portion 46 which is arranged to face upstream toward the inlet end of passage 17 such that air passing through induction passage 17 is enabled to impinge upon fuel in the fuel channel gap causing some portion of the available fuel to leave the fuel channel and mix with the air to form an air fuel mixture. Receiver tube 38 is mounted telescopically over jet tube 37 and is adjustable lengthwise to establish one end of the exposed portion of gap 46. As shown, receiver tube 38 is secured to outlet fitting 42 which is adjustable inwardly and outwardly by means of threads 47, 48. When the receiver tube 38 has been adjusted to a desired location with respect to the gap 46 in jet tube 37, the receiver tube and outlet fitting 42 are secured by means of lock nut 49. Outlet fitting 42 is sealed by means of a rubber seal ring 51. Inlet fitting 36 is sealed against fuel leakage by rubber seal ring 52 and is secured in a bore 53 in body 16 by a locking ring 54. The apparatus described thus far provides for manual adjustment or tuning of the charge forming apparatus in order to provide air fuel mixtures conforming to a desired air fuel ratio curve throughout the range of air flow for the apparatus. During engine operation, it may be desirable to change the air fuel ratio of the mixture for short periods of time due to such factors as ambient temperatures or the chemical content of the exhaust gasses. To this end a remotely operable reciprocable shield 61 is provided for varying the exposed length of gap 46 in response to a remotely sensed condition.

Figure 3:
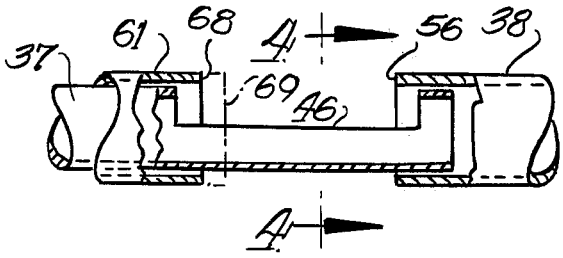
FIG. 3 is an enlarged fragmentary view of a fuel channel and shield.
Figure 4:
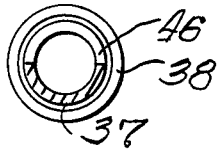
FIG. 4 is a view of the fuel channel taken along the line 4—4 of FIG. 3.
Figure 4:
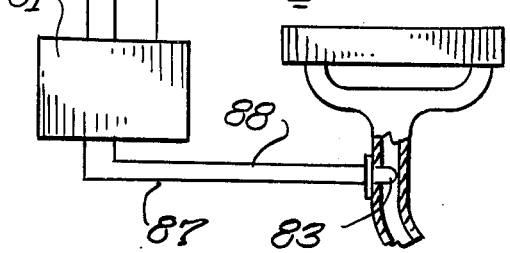

In the embodiment of FIGS. 1 and 2, shield 61 surrounds jet tube 37 and is mounted on a leaf spring 62. Slots 63, 64 are formed in lower portion 19 of body 16 for receiving the ends of leaf spring 62. Packing members 66, 67 are provided to prevent air leakage through slots 63, 64. An end 68 of shield 61 extends over gap 46 in jet tube 37 such that the effective gap length exposed to impingement by the inducted air stream is defined by the end 68 of shield 61 and the end 56 of receiver tube 38. Reciprocation of shield 61 with respect to jet tube 37 while receiver tube 38 remains stationary results in changing the effective length of gap 46 exposed to the inducted air stream and thus results in changing the air-fuel ratio of the mixture, a longer effective gap length providing a richer mixture while a shorter effective gap length provides a leaner mixture. Reciprocable movement of shield 61 with respect to gap 47 is indicated in FIG. 3 by the broken line 69.

Drive means 71 is provided for moving shield 61 with respect to jet tube 37 and includes an electromagnetic transducer device having a permanent magnet portion 72, a core piece 73 and a movable wound coil armature 74. Flow of electrical current in wound armature 74 causes the armature to move with respect to the magnetic field formed by the permanent magnet portion 72 and the core piece 73. A plunger 76 is secured to armature 74 and extends through an opening 77 in body 16 into engagement with leaf spring 62 on which shield 61 is mounted. The transducer device is enclosed in a housing 78 including a flexible diaphragm 79 for sealing the magnetic components from contact with air or mixtures of fuel and air in induction passage 17. Armature 74 is electrically connected to an amplifier device 81 which in turn is electrically connected to a source of power such as a storage battery 82 and to one or more remote sensors indicated by reference character 83. The various electrical connections are indicated schematically by reference characters 84, 86, 87, 88, 89, 91. In operation, a remotely sensed condition or conditions such as temperature, or the oxygen content of exhaust gases and so forth are sensed by one or more sensors 83 and a corresponding signal is conducted to control amplifier means 81 which regulates the flow of electrical current armature 74 through connections 84, 86 in accordance with the sensed condition or a combination thereof. The flow of electrical current in armature 74 exerts a force on plunger 76 which in turn acts upon leaf spring 62 for moving shield 61 with respect to jet tube gap 46 and thereby influences the air fuel ratio of the mixture. In the embodiment shown in FIGS. 1 and 2, it is assumed that the manual adjustment of receiver tube 38 will be set for the richest desired mixture and that the electromagnetic transducer will act, when energized, to provide a leaner mixture. When the transducer is de-energized, the spring returns the shield to its original position. It is thus possible to provide a rich mixture for starting an engine, and then to provide for leaner mixture operation in accordance with an error signal from control amplifier 86 as sensed by an exhaust gas oxygen sensor 83. In other forms of the apparatus, it is contemplated that the control amplifier 81 will provide reverse polarity such that the shield is movable in opposite directions by the armature to provide either richer or leaner mixtures.

Certain modified forms of shield and mounting means therefor are shown fragmentarily in FIGS. 5 through 10. For ease in understanding the drawings, the reference characters of FIGS. 1–5 are used to indicate similar components while new reference characters are used to indicate modified forms of components.

Figure 5:
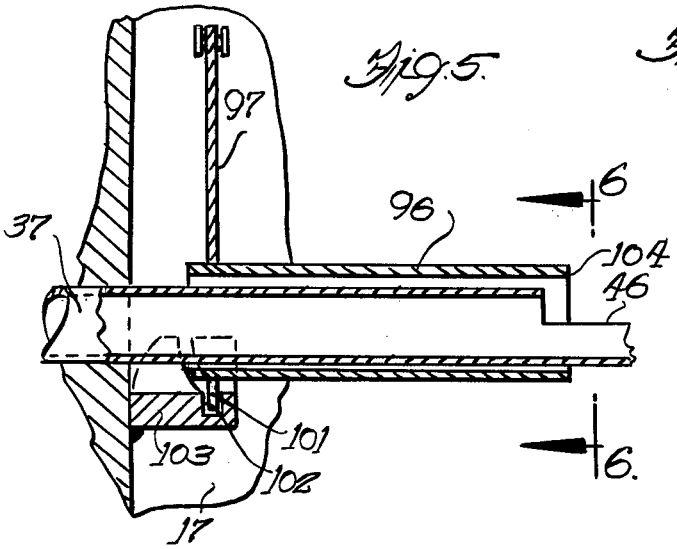
FIG. 5 is a fragmentary view of an alternate form of mounting means for a shield.
Figure 6:
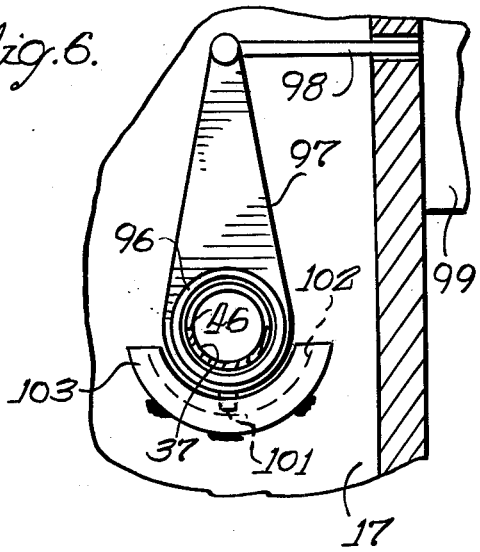
FIG. 6 is a view taken along the line 6—6 of FIG. 5.

In FIGS. 5 and 6, a shield 96 is shown mounted on and supported by a lever arm 97. The upper end of lever arm 97 is pivotally connected to a push-pull plunger 98 extending from a drive means 99. The lower end of lever arm 97 includes a tab 101 which is received in a helical slot 102 formed in a plate 103. In the embodiment of FIGS. 5 and 6, push-pull motion of plunger 98 causes counterclockwise and clockwise turning of lever arm 97 which in turn causes back and forth movement of shield 96 with respect to gap 46 inasmuch as the lever is engaged with helical slot 102. Thus push-pull movement of plunger 98 is effective to change the air-fuel ratio of the mixture by moving the end 104 of shield 96 with respect to gap 46 to change the effective length of the gap exposed to impingement by the induced air stream.

Figure 7:
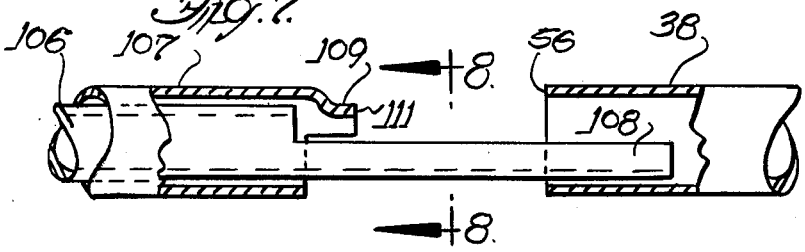
FIG. 7 is a fragmentary view of a modified form of shield.
Figure 8:
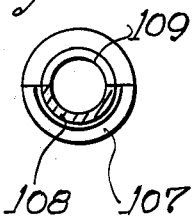
FIG. 8 is a view taken along the line 8—8 of FIG. 7.

In FIGS. 7 and 8, a modified form of jet tube 106 and shield 107 are shown in relation to a receiver tube 38. The upper half of jet tube 106 has been removed for a distance from the end to form a trough-like portion 108. Shield 107 includes a convergent nose portion 109 providing a restriction formed on the upper portion thereof. The nose portion 109 formed on the upper part of shield 107 and the channel 108 formed in the lower part of jet tube 106 form a nozzle structure which act upon a stream of fuel flowing through the open gap between the end 111 of shield 107 and the end 56 of receiver tube 38. The shield 107 is mounted for movement parallel to channel 108 for changing the effective gap length exposed to the inducted air stream.

Figure 9:
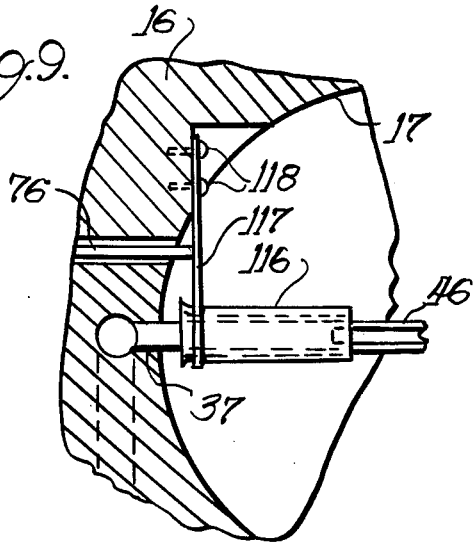
FIG. 9 is a fragmentary view of an alternate form of mounting means for a shield.

In FIG. 9, a modified form of mounting means for a shield 116 is shown as including a cantilever leaf spring 117 having one end secured to body 16 by fastening means 118.

Figure 10:
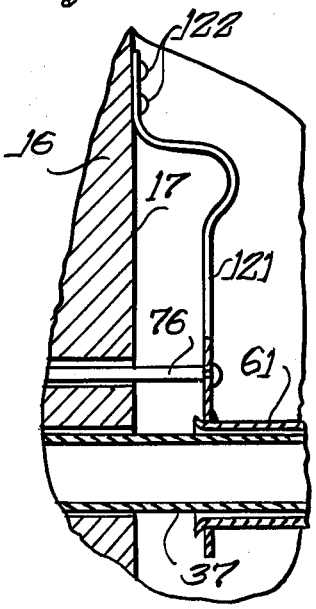
FIG. 10 is a fragmentary view of a still further alternative form of mounting means for a shield.

FIG. 10 shows a shield 61 mounted on a vertically extending leaf spring 121 which has one end secured to a wall of induction passage 17 by fastening means 122. The end of plunger 76 is secured to spring 121 and is capable of moving shield 61 forward or backward from a neutral position.

In the foregoing description, charge forming apparatus has been described wherein the air fuel ratio of a mixture can be modified by moving a shield along a fuel channel to change the length of a gap in the channel in which the fuel is exposed to impingement by a stream of inducted air.

What is claimed is:

1. Charge forming apparatus including a body member having an air induction passage defined therein provided with throttle means arranged for regulating the rate of air flow therethrough, said body member having fuel passage means defined therein including a fuel channel extending into said air induction passage, said fuel channel including an exposed gap facing substantially upstream of said air induction passage permitting impingement of an air stream upon a fuel stream in said fuel channel for deflecting fuel from said fuel channel into said induction passage in proportion to air flowing in said induction passage, forming an air and fuel mixture therein, wherein the improvement comprises an intermittently movable shield mounted for overlapping a portion of said gap defining a variable exposed gap length, including a spring connected between said body member and said shield, resiliently supporting said shield in a selected position with respect to said fuel channel gap, and drive means operatively coupled with said shield for displacing said shield from said selected position thereby changing the length of said exposed gap, said drive means being remotely operable for controlling the position of said shield with respect to said gap providing variable adjustment of the ratio of fuel and air in said induction passage.

2. Charge forming apparatus according to claim 1, wherein said drive means includes an electromagnetic transducer means having a movable element arranged and disposed for regulating the position of said shield with respect to said fuel channel gap, and an electrical control circuit connected to said transducer means energizing said transducer means in accordance with a remotely sensed condition.

3. Charge forming apparatus according to claim 1 wherein said shield includes a restricted portion adjacent said fuel channel gap portion, said restricted portion of said shield defining in combination with said channel, a nozzle structure movable with respect to said channel for varying the exposed length of said gap portion.

* * * * *